US009179218B2

(12) United States Patent
Jeong et al.

(10) Patent No.: US 9,179,218 B2
(45) Date of Patent: Nov. 3, 2015

(54) MOBILE DEVICE FOR MULTI-CHANNEL SOUND COLLECTION AND OUTPUT USING COMMON CONNECTOR, AND DRIVING METHOD THEREOF

(75) Inventors: Sung-Hoon Jeong, Gyeonggi-do (KR); Ju-Hee Chang, Gyeonggi-do (KR); Hyo-Sun Jang, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 519 days.

(21) Appl. No.: 13/557,835

(22) Filed: Jul. 25, 2012

(65) Prior Publication Data

US 2013/0064381 A1 Mar. 14, 2013

(30) Foreign Application Priority Data

Sep. 14, 2011 (KR) ..... 10-2011-0092438

(51) Int. Cl.
*H04R 5/04* (2006.01)
*H04R 29/00* (2006.01)

(52) U.S. Cl.
CPC *H04R 5/04* (2013.01); *H04R 29/00* (2013.01); *H04R 2420/01* (2013.01); *H04R 2420/09* (2013.01)

(58) Field of Classification Search
CPC ..... H04R 29/00; H04R 2420/01; H04R 2420/03; H04R 2420/05; H04R 2420/09; H04R 5/04
USPC ..... 381/123, 1, 11, 22, 23, 74, 375, 384, 381/58, 81; 455/418, 570, 575.2, 569.1, 455/559
See application file for complete search history.

(56) References Cited

U.S. PATENT DOCUMENTS

| | | | | |
|---|---|---|---|---|
| 6,856,046 | B1 | 2/2005 | Scarlett et al. | |
| 2004/0081099 | A1 * | 4/2004 | Patterson et al. | 370/241 |
| 2004/0122541 | A1 | 6/2004 | DiSanza et al. | |

FOREIGN PATENT DOCUMENTS

| | | | |
|---|---|---|---|
| EP | 2 224 748 | A1 | 9/2010 |
| WO | 2004/001552 | A2 | 12/2003 |

OTHER PUBLICATIONS

Wikipedia, "S/PDIF—Sep. 8, 2010 Revision", 5 pages.*

* cited by examiner

*Primary Examiner* — Vivian Chin
*Assistant Examiner* — David Ton
(74) *Attorney, Agent, or Firm* — Cha & Reiter, LLC

(57) ABSTRACT

A mobile device for providing multi-channel sound collection and output using a common connector, and a driving method thereof are provided. A mobile device having a sound compressor and a sound decompressor includes a connector slidably receiving a sound collector plug or a sound output plug, a plug identification unit for, if one of the sound collector plug and the sound output plug is coupled to the connector, identifying if the plug coupled to the connector is the sound collector plug or is the sound output plug, a switching unit for electrically coupling the plug coupled to the connector, to the sound compressor, or electrically coupling the plug coupled to the connector, to the sound decompressor, and a controller for controlling switching of the switching unit according to the identification outcome.

17 Claims, 6 Drawing Sheets

MOBILE DEVICE FOR MULTI-CHANNEL SOUND COLLECTION AND OUTPUT USING COMMON CONNECTOR, AND DRIVING METHOD THEREOF

CLAIM OF PRIORITY

This application claims the benefit to a Korean patent application filed in the Korean Intellectual Property Office on Sep. 14, 2011 and assigned Serial No. 10-2011-0092438, the entire disclosure of which is herein incorporated by reference.

BACKGROUND OF THE INVENTION

1. Field of the Invention

The present invention relates to a mobile device for providing a multi-channel sound collection and output scheme using a common connector, and a driving method thereof.

2. Description of the Related Art

Recently, with the rapid development of a digital data compression technology, a communication technology, a semiconductor integrated circuit technology, ever-increasing memory storage capacity, a mobile device such as a cellular phone, a Portable Digital Assistant (PDA), etc. is gradually evolving from a simple function of exchanging voice signals between users to a multi-function, such as an image photographing and transmission function, a sound collection and reproduction function, a game play function, a wireless Internet access function, etc. Particularly, with the popularization of the image photographing and transmission functions using the mobile device, a user's desire for lively recording direct sound together with image photographing is growing.

However, in general, a microphone installed in a mobile device provides poor sensitivity performance, and a sound transmission path of an external connector is of a monophonic type. Thus, there is a problem that the microphone cannot lively record direct sound by a multi channel according to user's demand.

To lively record direct sound, there is a need to connect a separate external multi-channel microphone to a mobile device. This requires installing a separate connector to connect to the external multi-channel microphone plug in the mobile device. However, as the mobile device is an electronic device prioritizing user's portability, it is not desirable to implement an additional connector due to limited in its size. Accordingly, there is a problem that the mobile device may have a spatial restriction in installing a connector for coupling to a plug for the external multi-channel microphone.

Therefore, there is a need for an improved scheme to use the existing plug without the need of an additional connector in a mobile terminal to provide means to lively record direct sound using a multi channel as a user desires.

SUMMARY OF THE INVENTION

An aspect of the present invention is to address at least the above problems and/or disadvantages and to provide at least the advantages below. Accordingly, one aspect of the present invention is to provide a mobile device for collecting external audio sound using a multi channel or decoding compressed sound and outputting the decoded sound to the external by using a common connector and a circuit of an external sound output (such as an earphone, a headphone, a speaker, etc. and an external multi-channel sound collector such as a microphone), and a driving method thereof.

The above aspects are achieved by providing a mobile device for sound multi-channel collection and output using a common connector, and a driving method thereof.

According to one aspect of the present invention, a mobile device having a sound compressor and a sound decompressor includes a connector for insertably receiving a sound collector plug or a sound output plug, a plug identification unit for, if one of the sound collector plug and the sound output plug is slidably coupled to the connector, identifying weather the plug coupled to the connector is the sound collector plug or the sound output plug, a switching unit for electrically coupling the plug coupled to the connector to one of the sound compressor and the sound decompressor, and a controller for controlling switching of the switching unit according to the identification result of the plug identification unit.

The mobile device may further include an impedance measurement unit for measuring the impedance of the plug coupled to the connector. In this case, the plug identification unit may identify the plug coupled to the connector on the basis of the impedance measured by the impedance measurement unit.

In the embodiment, the connector may include a 1st terminal electrically coupled with the sound collector plug, a 2nd terminal electrically coupled with a left output line of the sound output plug, and a 3rd terminal electrically coupled with a right output line of the sound output plug. Alternatively, the connector may include a 1st terminal electrically coupled with a left output line of the sound output plug or electrically coupled with a left input line of the sound collector plug according to the switching of the switching unit, and a 2nd terminal electrically coupled with a right output line of the sound output plug or electrically coupled with a right input line of the sound collector plug according to the switching of the switching unit.

According to another aspect of the present invention, a driving method of a mobile device having a soundcompressor, a sound decompressor, and a connector insertably coupled to a sound collector plug or a sound output plug includes, if a plug is coupled to the connector, identifying if the plug coupled to the connector is the sound collector plug or is the sound output plug, and, coupled switching to electrically couple the plug coupled to the connector to one of the sound compressor and the sound decompressor according to the identification outcome.

Other aspects, advantages and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features and advantages of certain exemplary embodiments of the present invention will be more apparent from the following description taken in conjunction with the accompanying drawings in which.

DETAILED DESCRIPTION

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

Figure 1:
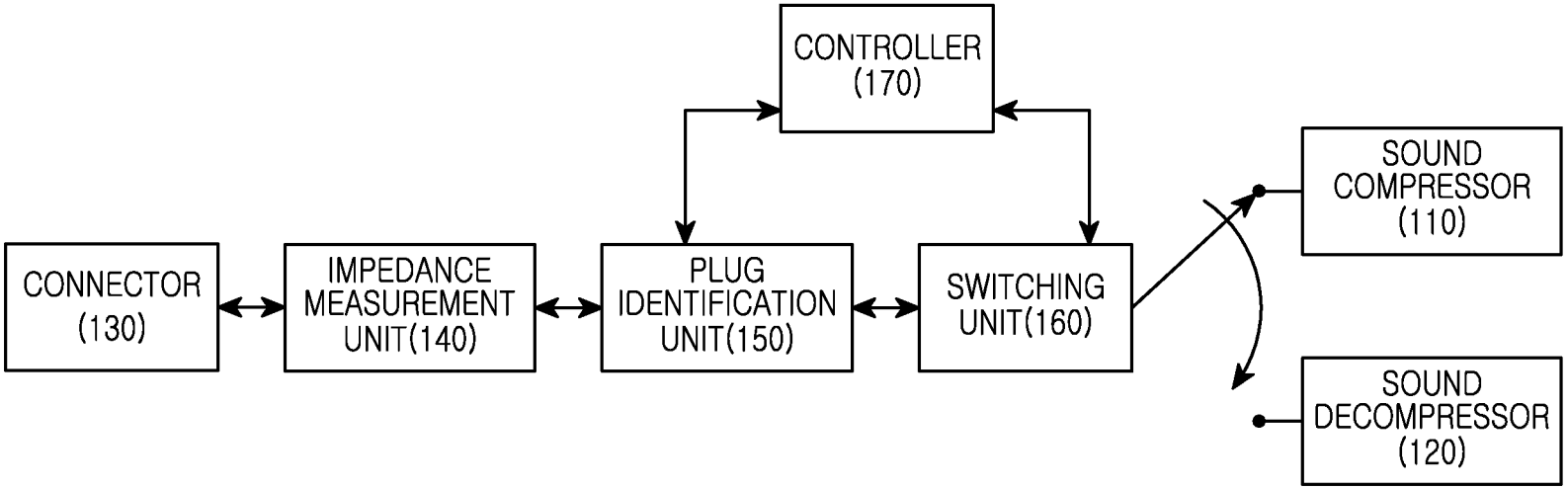
FIG. 1 is a schematic diagram illustrating a construction of a mobile device according to an exemplary embodiment of the present invention.

FIG. 1 is a schematic diagram illustrating a construction of a mobile device according to an exemplary embodiment of the present invention.

Referring to FIG. 1, the mobile device can include a sound compressor 110, a sound decompressor 120, a connector 130, an impedance measurement unit 140, a plug identification unit 150, a switching unit 160, and a controller 170.

In operation, the sound compressor 110 converts collected peripheral audio sound into digital audio signals and compresses the digital audio signals. A sound compression method by the sound compressor 110 can follow various compression technologies widely known in the art, and its detailed description is omitted herein. For example, compressing of a digital audio signal can be performed using various known technologies such as MPEG-1 Audio Layer 3 (MP3), Advanced Audio Coding (AAC), Window Media Audio (WMA), Dolby Audio Compression (AC-3) and the like. These audio signal compression technology types applying psychology sound are capable of transmitting a high fidelity audio signal because it can maintain the almost subjectively same sound quality as the original sound while obtaining a compression rate of 10:1 or more. That is, the audio signal compression technology can perform a more efficient signal processing, by incorporating how a human recognizes sound using a result of research on psychology sound and not processing an unnecessary portion of an audio signal. The most typical example is to perform sampling using the knowledge that a human's maximum audio frequency is 20,000 Hertz (Hz). Note that a compression technology applicable by the sound compressor 110 is not limited to a compression technology disclosed herein.

The sound decompressor 120 decodes compressed digital audio signals. To this end, the sound decompressor 120 can apply a decompression technology corresponding to a compression technology applied to the compressed digital audio signals. The decompression technology for the digital audio signal follows a technology widely known in the art, thus its detailed description is omitted herein.

The connector 130 is provided in the mobile device to receive an external plug of a sound collector or a sound output device, which is insertably coupled to the connector 130. Here, the sound collector refers to a device collecting peripheral sound such as a microphone, and the sound output device refers to a device forwarding sound to a user such as an earphone, a speaker, a headphone, etc. Also, the plug of an external sound collector or sound output device is slidably inserted into the connector 130 and serves to relay electrical forwarding and reception of an audio signal.

Figure 2:
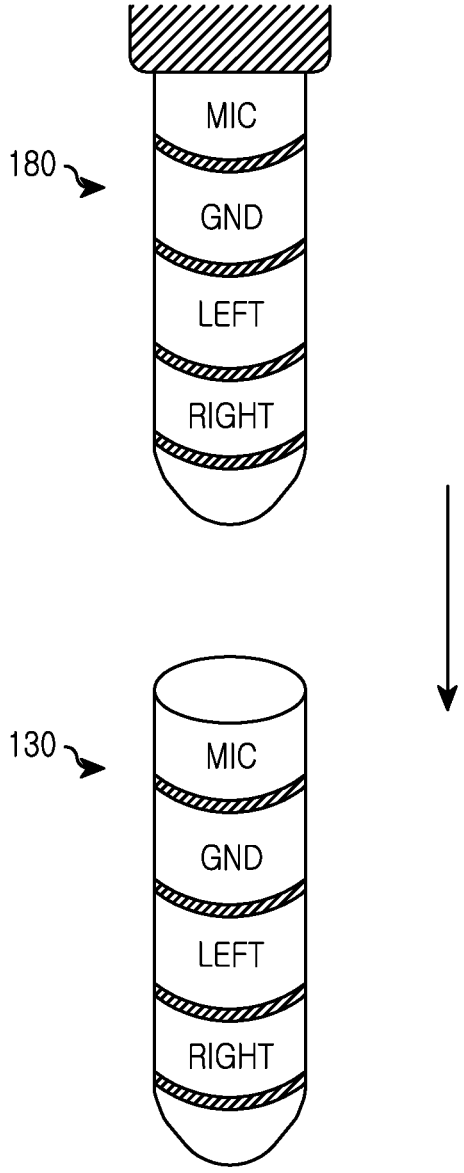
FIG. 2 is a diagram illustrating an example of a connector used in an exemplary embodiment of the present invention and a plug connected to the connector.

In the embodiment, the connector 130, which may be a socket installed in the mobile device, can slidably coupled to the plug of the sound collector or the plug of the sound output device, and then relay electrical forwarding and reception of an audio signal between the devices. For example, the connector 130 can be a cylindrical hole of a 3.5 pi size as illustrated in FIG. 2. Therefore, the connector 130 can slidably receive a sound collector plug or sound output plug of a 3.5 pi size thereto.

As shown in FIG. 2, reference number '180' integrally denotes the sound collector plug and the sound output plug. The sound collector plug or sound output plug 180 may include a microphone terminal (MIC), a ground terminal (GND), a left output/input terminal (LEFT), and a right output/input terminal (RIGHT) as illustrated in FIG. 2. Also, the connector 130 may include a microphone terminal (MIC), a ground terminal (GND), a left output/input terminal (LEFT), and a right output/input terminal (RIGHT).

In the connector 130, the microphone terminal (MIC), which is a contact terminal for receiving an audio signal collected by a microphone, can contact with a general monophonic microphone. The ground terminal (GND) is a terminal for moving unnecessary electric charges to reference electric potential and preventing the damage or erroneous operation of the mobile device. The left output/input terminal (LEFT) is a contact terminal for, when a plug connected to the connector 130 is a plug of a sound output device, outputting sound to a left line of the sound output device and receiving sound collected through a left line of the sound collector (e.g., the stereophonic microphone) when the plug connected to the connector 130 is a plug of a sound collector (e.g., a stereophonic microphone). Similarly, the right output/input terminal (RIGHT) is a contact terminal for, when a plug connected to the connector 130 is a plug of a sound output, outputting sound to a right line of the sound output and receiving sound collected through a right line of the sound collector (e.g., the stereophonic microphone) when the plug connected to the connector 130 is a plug of a sound collector (e.g., a stereophonic microphone).

The impedance measurement unit 140 can measure the impedance of a plug in contact with the connector 130. For illustrative purposes, each terminal of the connector 130 can connect with a circuit exemplified in FIG. 3. Here, if a sound collector plug or a sound output plug is insertably coupled to the connector 130, contact terminals of the connected plug and the connector 130 are electrically in contact with each other according to the type of the connected plug. For example, when the plug connected to the connector 130 is a plug of a monophonic microphone, microphone terminals (MIC) of the monophonic microphone and the connector 130 are electrically in contact with each other. When the connected plug is a plug of a stereophonic microphone, left input terminals (LEFT) and right input terminals (RIGHT) of the stereophonic microphone and the connector 130 are electrically in contact with each other, respectively. Similarly, when the connected plug is a plug of a sound output device, left output terminals (LEFT) and right output terminals (RIGHT) of the sound output device and the connector 130 are electrically in contact with each other, respectively. At this time, if the contact terminal of the sound collector plug or sound output plug, and the contact terminal of the connector 130 are electrically connected with each other, impedance is formed between the respective contact terminals, thus the impedance measurement unit 140 can measure the impedance of a particular plug connected to the connector 130.

According to the type of a plug connected to the connector 130 as explained above, the impedance formed by contact terminals of the plug and the connector 130 can be varied.

For example, when a sound output plug such as an earphone plug or a speaker plug is connected to the connector 130, impedance formed by contact terminals of the sound output plug and the connector 130 can be measured to be 16 ohm (Ω) to 32 Ω.

Also, when a monophonic microphone plug is connected to the connector 130, impedance formed by contact terminals of the monophonic microphone plug and the connector 130 can be measured to be 1.5 kilo ohm (kΩ) to 3.5 kΩ.

Further, when a stereophonic microphone plug is connected to the connector 130, it is considered a parallel connection of impedance of monophonic microphone plugs and therefore, impedance formed by contact terminals of the stereophonic microphone plug and the connector 130 can be measured to be about ½ of the impedance of the monophonic microphone plugs. This is based on the properties that, in a case where a microphone plug and a speaker plug or an earphone plug are connected to a connector of the same circuit, an impedance value formed by a contact terminal of the microphone plug is generally larger than an impedance value formed by a contact terminal of the speaker plug or earphone plug. It should be further noted that a range of each of the formed impedance can be varied due to internal resistance or values of other devices.

Using the above principle, if a sound collector plug or a sound output plug is connected to the connector 130, the plug identification unit 150 identifies if a plug slidably connected to the connector 130 is the sound collector plug or is the sound output plug. Here, the plug identification unit 150 can identify the plug connected to the connector 130 through a comparison between an impedance value measured by the impedance measurement unit 140 and a preset value.

For example, when impedance measured by the impedance measurement unit 140 is within a range of 16Ω to 32Ω as above, the plug identification unit 150 can determine that the sound output plug such as an earphone plug or a speaker plug is electrically connected to the connector 130. When the measured impedance is within a range of 1.5 kΩ or 3.5 kΩ, the plug identification unit 150 can determine that a monophonic microphone plug is electrically connected to the connector 130. Also, when the measured impedance is measured as about ½ of impedance of the monophonic microphone plug connected to the connector 130, it is supposed to be a parallel connection of impedance of monophonic microphone plugs and therefore, the plug identification unit 150 can determine that a stereophonic microphone plug is electrically connected to the connector 130.

The switching unit 160 selectively and electrically connects a plug connected to the connector 130, to the sound compressor 110 or the sound decompressor 120. Here, the controller 170 can control the switching operation of the switching unit 160 according to the identification result of the plug identification unit 150. That is, when the connected plug is a plug of a sound collector, a contact terminal of the connector 130 can be electrically connected to the sound compressor 110. As such, the sound compressor 110 can compress an audio signal collected by the sound collector, into a digital audio signal.

Also, when the connected plug is a plug of a sound output device, the contact terminal of the connector 130 can be electrically connected to the sound decompressor 120. Thus, the sound decompressor 120 can decompress a signal and output the decompressed signal through the sound output. For example, when the plug connected to the connector 130 is a stereophonic microphone plug, contact terminals of a left line and a right line of the connector 130 can be independently connected to the sound compressor 110, respectively. As a result, the sound compressor 110 independently compresses audio signals collected from the contact terminals of the left line and the right line of the connector 130, respectively. Similarly, when the plug connected to the connector 130 is a stereophonic sound output plug, the contact terminals of the left line and the right line of the connector 130 can be independently connected to the sound decompressor 120, respectively. Therefore, the sound decompressor 120 can independently decompress signals and output the decompressed signals, respectively. A technology for an independent sound collection or sound output method of left and right lines of a stereophonic microphone or a stereophonic sound output follows a technology widely known in the art and, thus its detailed description is omitted herein.

Figure 4:
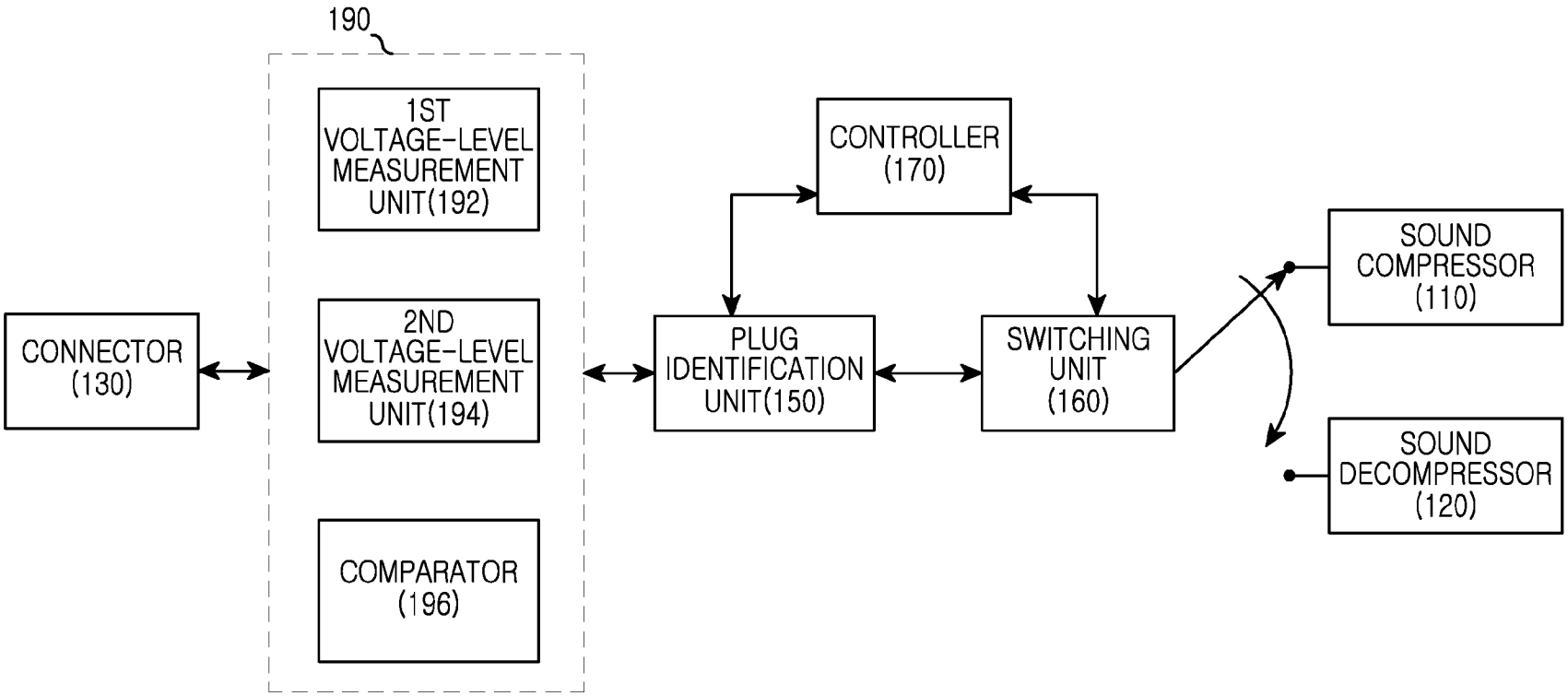
FIG. 4 is a schematic diagram illustrating a mobile device according to another exemplary embodiment of the present invention.

FIG. 4 is a schematic diagram illustrating a mobile device according to another exemplary embodiment of the present invention.

Referring to FIG. 4, the mobile device may include a sound compressor 110, a sound decompressor 120, a connector 130, a plug identification unit 150, a switching unit 160, a controller 170, and a voltage level measurement unit 190. Here, the sound compressor 110, the sound decompressor 120, the connector 130, the plug identification unit 150, the switching unit 160, and the controller 170 of FIG. 4 have the same or like functions to the sound compressor 110, the sound decompressor 120, the connector 130, the plug identification unit 150, the switching unit 160, and the controller 170 of FIG. 1. Therefore, the constituent elements are denoted by the same reference numbers, and their detailed descriptions are omitted herein to avoid redundancy.

The voltage level measurement unit 190 may include a 1st voltage-level measurement unit 192, a 2nd voltage-level measurement unit 194, and a comparator 196. Although two voltage-level measurement units are shown for illustrative purposes, it should be note that the number of units shown in the drawing should not limit the scope of the invention.

The 1st voltage-level measurement unit 192 measures a voltage level of a contact terminal of a microphone plug connected to the connector 130. The 2nd voltage-level measurement unit 194 measures a voltage level of at least one of a left output/input terminal and right output/input terminal of a stereophonic sound output plug or stereophonic microphone plug connected to the connector 130.

When a microphone plug is slidably coupled to the connector 130 of the same circuit, in case of a stereophonic microphone, a voltage level of a microphone terminal (MIC) of the connector 130 is substantially equal to a voltage level of a left output/input terminal (LEFT) or right output/input terminal (RIGHT) of the connector 130 or, in case of a monophonic microphone, a voltage level applied to the microphone terminal (MIC) of the connector 130 is lower than a voltage level applied to the left output/input terminal (LEFT) or right output/input terminal (RIGHT) of the connector 130. In contrast, when a speaker plug or an earphone plug is slidably coupled to the connector 130 of the same circuit, a voltage level applied to the microphone terminal (MIC) of the connector 130 is higher than a voltage level applied to the left output/input terminal (LEFT) or right output/input terminal (RIGHT) of the connector 130.

By using the above properties, the comparator 196 can compare a voltage level measured by the 1st voltage-level measurement unit 192 and a voltage level measured by the 2nd voltage-level measurement unit 194, and then the plug identification unit 150 can identify a plug connected to the connector 130 on the basis of the comparison result of the comparator 196.

Figure 5:
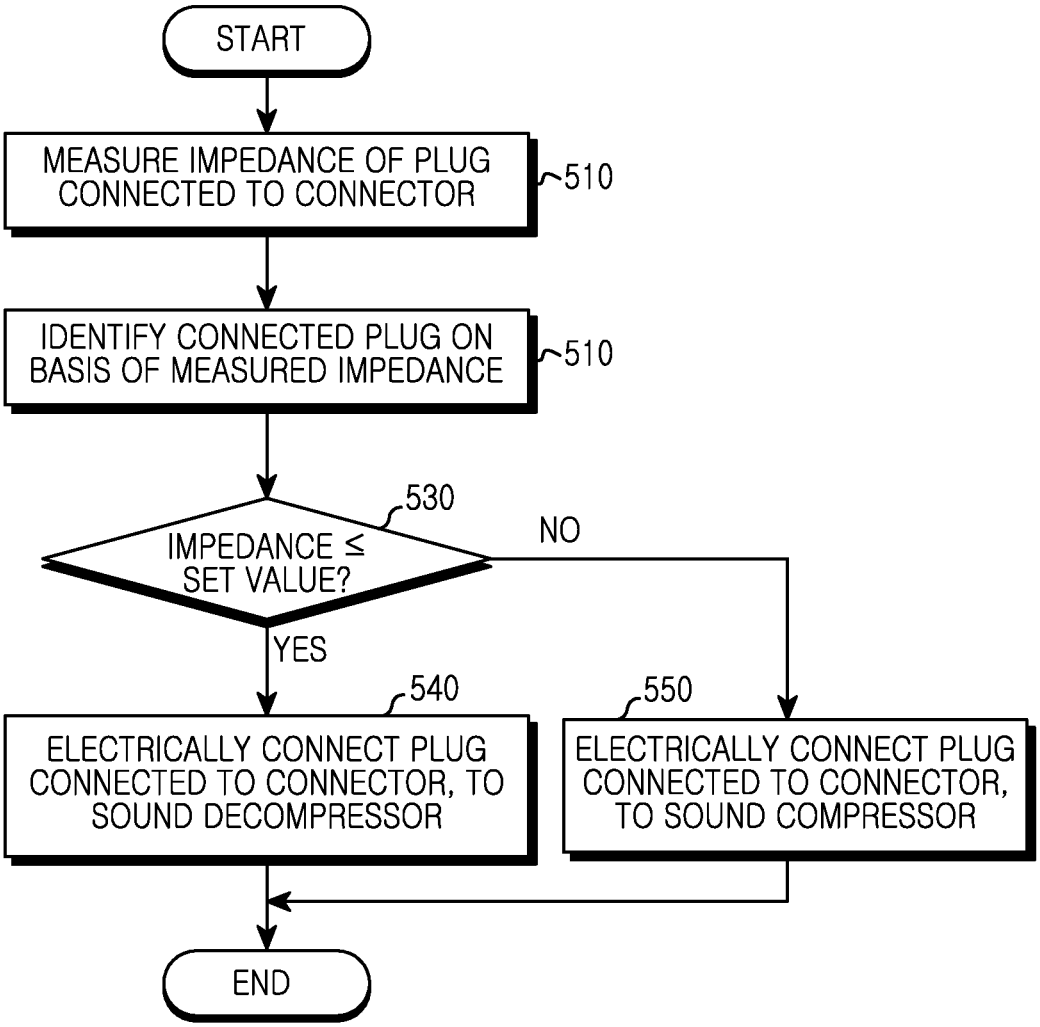
FIG. 5 is a flowchart illustrating a driving method of a mobile device according to an exemplary embodiment of the present invention.

FIG. 5 is a flowchart illustrating a driving method of a mobile device according to an exemplary embodiment of the present invention.

Referring to FIGS. 1 and 5, when a microphone plug, an earphone plug or a speaker plug is sliably coupled to the connector 130, the impedance measurement unit 140 can measure the impedance of the plug connected to each terminal of the connector 130 (step 510). Here, (1) the impedance formed by contact terminals of the plug and the connector 130 can be measured according to the type of the plug connected to the connector 130. For example, when a sound output plug such as an earphone plug or a speaker plug is connected to the connector 130, impedance formed by contact terminals of the sound output plug and the connector 130 can be measured in the range of 16Ω to 32Ω. Alternatively, when a monophonic microphone plug is connected to the connector 130, impedance formed by contact terminals of the monophonic microphone plug and the connector 130 can be measured in the range of 1.5 kΩ to 3.5 kΩ. Alternatively, when a stereophonic microphone plug is connected to the connector 130, it serves as a parallel connection of impedance of monophonic microphone plugs and therefore, impedance formed by contact terminals of the stereophonic microphone plug and the connector 130 can be measured as about ½ of the impedance of the monophonic microphone plugs.

Accordingly, the plug identification unit 150 can identify a plug connected to the connector 130 through a comparison process between the impedance value measured by the impedance measurement unit 140 and a preset value (step 520). For example, the plug identification unit 150 sets a maximum impedance value that can be measured when an earphone plug or a speaker plug is connected to the connector 130. Then, if an impedance value equal to or less than the set value is measured by the impedance measurement unit 140, the plug identification unit 150 can determine that a plug connected to the connector 130 is the earphone plug or the speaker plug (step 530). In contrast, if an impedance value greater than the set value is measured by the impedance measurement unit 140, the plug identification unit 150 can determine that the plug connected to the connector 130 is a microphone plug (step 530).

Alternately, the plug identification unit 150 sets a 1st set value as a maximum impedance value that can be measured when an earphone plug or a speaker plug is connected to the connector 130 and sets a 2nd set value as a minimum impedance value that can be measured when a monophonic microphone plug is connected to the connector 130. Then, if an impedance value between the 1st set value and the 2nd set value is measured by the impedance measurement unit 140, the plug identification unit 150 may determine that a plug connected to the connector 130 is a stereophonic microphone plug. In this case, if an impedance value measured by the impedance measurement unit 140 is greater than the 2nd set value, the plug identification unit 150 can determine that the plug connected to the connector 130 is the monophonic microphone plug. If the measured impedance value is less than the 1st set value, the plug identification unit 150 can determine that the plug connected to the connector 130 is the speaker plug or the earphone plug.

Figure 3:
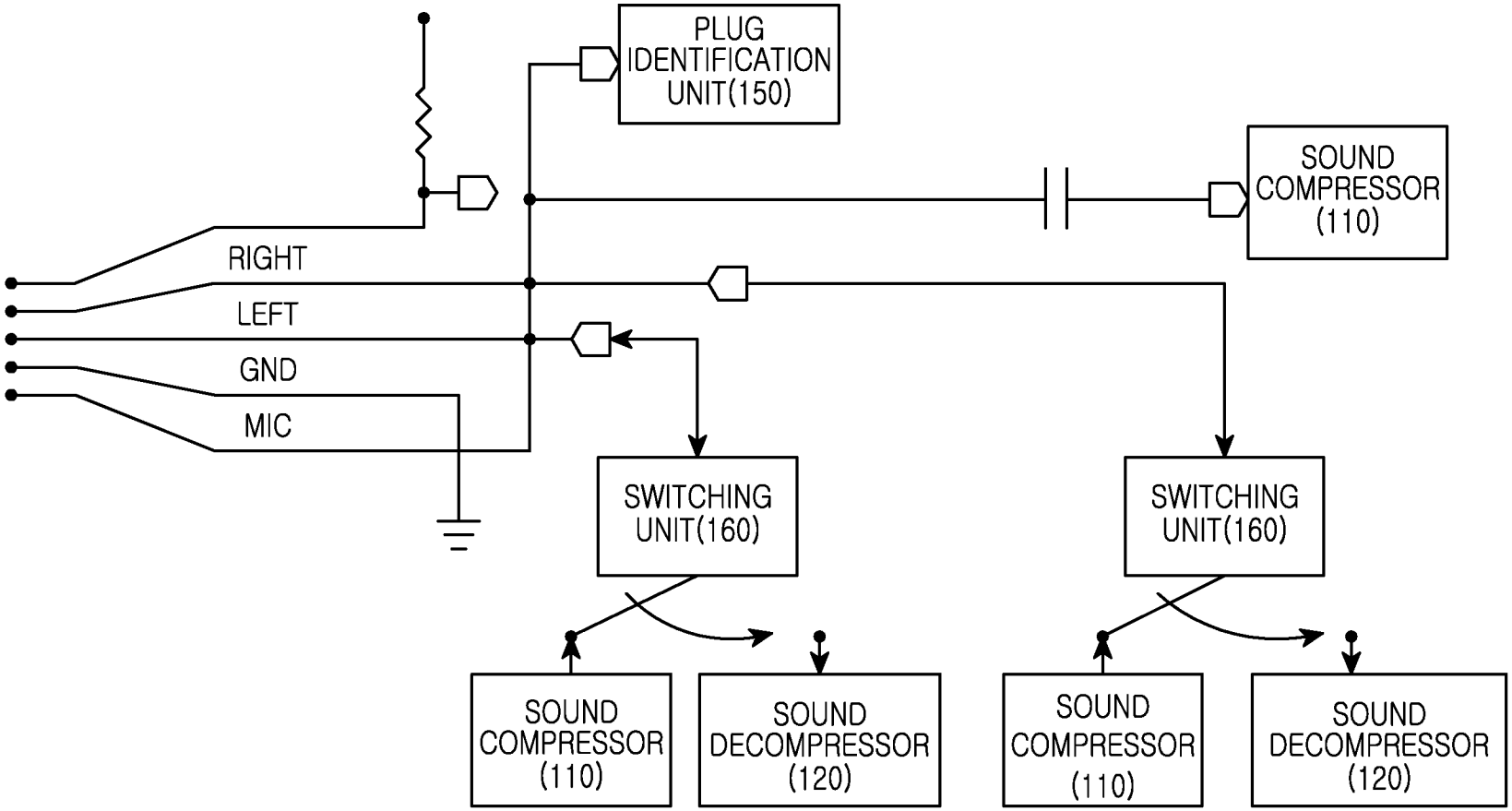
FIG. 3 is a diagram illustrating an example of an operation of a mobile device according to an exemplary embodiment of the present invention.

If the plug identification unit 150 determines that a plug connected to the connector 130 is a sound output plug (step 530), the controller 170 controls the switching operation of the switching unit 160 and electrically connects the plug connected to the connector 130, to the sound decompressor 120 (step 540). At this time, as illustrated in FIG. 3, the controller 170 can independently connect a left output terminal and right output terminal of the connector 130 to the sound decompressor 120, respectively. Hence, the sound decompressor 120 can decompress sound and output the decompressed sound to a left output line and right output line of a sound output, respectively, thereby being able to forward a live audio signal to a user.

If the plug identification unit 150 determines that a plug connected to the connector 130 is a sound collector plug (step 530), the controller 170 controls the switching operation of the switching unit 160 and electrically connects the plug connected to the connector 130, to the sound compressor 110 (step 550). Here, when the plug connected to the connector 130 is determined to be a plug of a stereophonic sound collector, as illustrated in FIG. 3, the controller 170 can independently connect a left input terminal and right input terminal of the connector 130 to the sound compressor 110, respectively, and the sound compressor 110 can independently compress audio signals received through a left input line and right input line of the stereophonic sound collector. Hence, the sound compressor 110 can separate the audio signals received by the stereophonic sound collector into a left signal and a right signal and independently compress the left signal and the right signal, thereby independently compressing collected direct sound signals into stereophonic sound signals.

Figure 6:
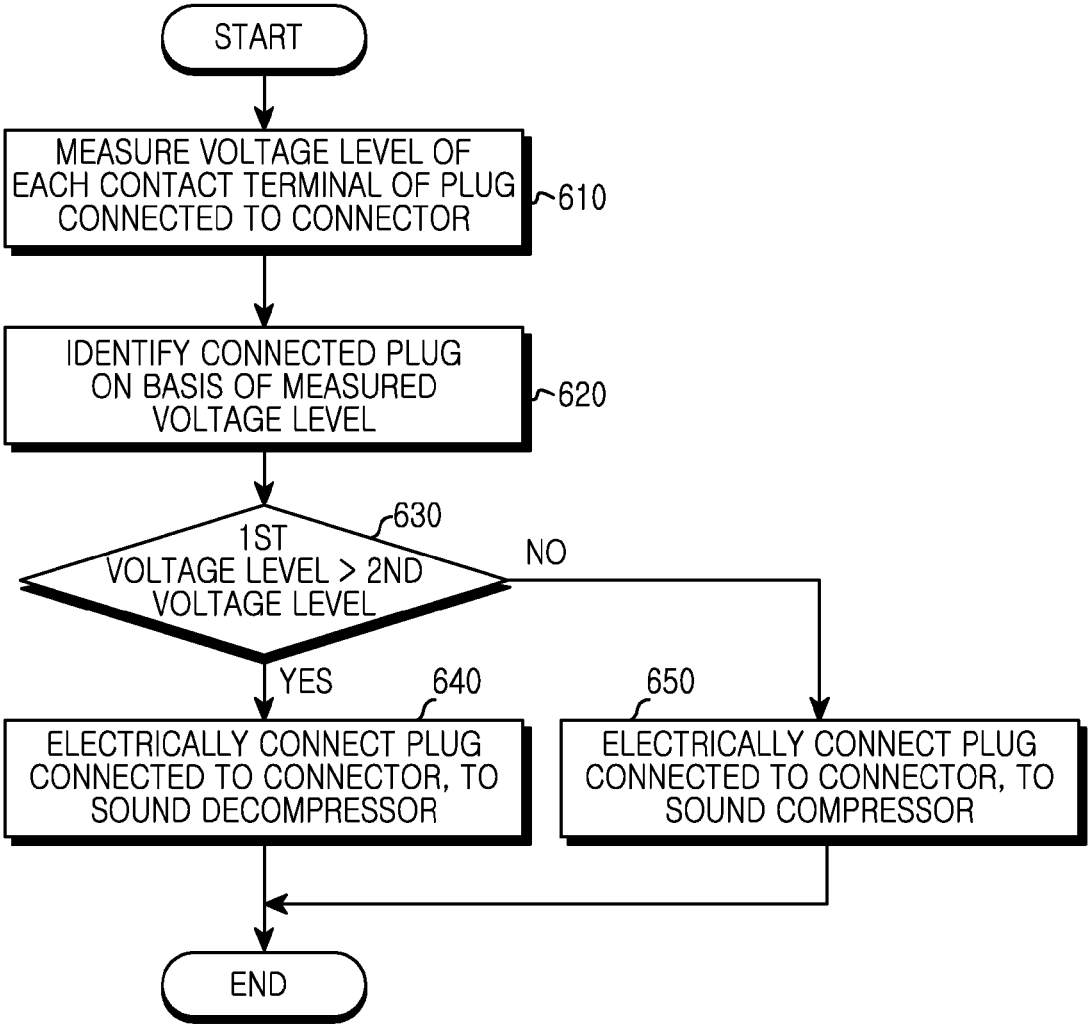
FIG. 6 is a flowchart illustrating a driving method of a mobile device according to another exemplary embodiment of the present invention.

FIG. 6 is a flowchart illustrating a driving method of a mobile device according to another exemplary embodiment of the present invention.

Referring to FIGS. 4 and 6, when a microphone plug, an earphone plug or a speaker plug is slidably coupled to the connector 130, the voltage level measurement unit 190 can measure a voltage level of a contact terminal of the microphone plug connected to the connector 130 through the 1st voltage-level measurement unit 192, and measure a voltage level of at least one of a left output/input terminal and right output/input terminal of a stereophonic sound output or a stereophonic microphone through the 2nd voltage-level measurement unit 194 (step 610).

When the microphone plug is slidably coupled to the connector 130 of the same circuit, in case of a stereophonic microphone, a voltage level of a microphone terminal (MIC) of the connector 130 is equal to a voltage level of a left output/input terminal (LEFT) or right output/input terminal (RIGHT) of the connector 130 or, in case of a monophonic microphone, a voltage level applied to the microphone terminal (MIC) of the connector 130 is lower than a voltage level applied to the left output/input terminal (LEFT) or right output/input terminal (RIGHT) of the connector 130.

In contrast, when the speaker plug or the earphone plug is slidably coupled to the connector 130 of the same circuit, a voltage level applied to the microphone terminal (MIC) of the connector 130 is higher than a voltage level applied to the left output/input terminal (LEFT) or right output/input terminal (RIGHT) of the connector 130.

By using above these principles, the comparator 196 can compare a voltage level measured by the 1st voltage-level measurement unit 192 and a voltage level measured by the 2nd voltage-level measurement unit 194, and the plug identification unit 150 can identify a plug connected to the connector 130 on the basis of the comparison outcome from the comparator 196 (step 620). Here, if the voltage level measured by the 1st voltage-level measurement unit 192 is equal to the voltage level measured by the 2nd voltage-level measurement unit 194, the plug identification unit 150 can determine that the stereophonic microphone is connected to the connector 130. If the voltage level measured by the 1st voltage-level measurement unit 192 is lower than the voltage level measured by the 2nd voltage-level measurement unit 194 by a set value or more, the plug identification unit 150 can determine that the monophonic microphone is connected to the connector 130. Further, if the voltage level measured by the 1st voltage-level measurement unit 192 is higher than the voltage level measured by the 2nd voltage-level measurement unit 194 by a set value or more, the plug identification unit 150 can determine that the earphone plug or the speaker plug is connected to the connector 130 (step 630).

If the plug identification unit 150 determines that a plug connected to the connector 130 is a sound output plug (step 630), the controller 170 controls the switching operation of the switching unit 160 and electrically connects the plug connected to the connector 130, to the sound decompressor 120 (step 640). At this time, as illustrated in FIG. 3, the controller 170 can independently connect a left output terminal and right output terminal of the connector 130 to the sound decompressor 120, respectively. Herein, for description convenience, a description has been made that a sound output outputs sound through its left output line and right output line, but the output line of the sound output may be realized as a multi line of three or more and output multi-channel stereophonic sound. Accordingly, the sound decompressor 120 can decompress sound and output the decompressed sound to the left output line and right output line of the sound output, respectively, thereby being able to forward a live audio signal to a user.

If the plug identification unit 150 determines that a plug connected to the connector 130 is a sound collector plug (step 630), the controller 170 controls the switching operation of the switching unit 160 and electrically connects the plug connected to the connector 130, to the sound compressor 110 (step 650). Here, when the plug connected to the connector 130 is determined to be a plug of a stereophonic sound collector, as illustrated in FIG. 3, the controller 170 can independently connect a left input terminal and right input terminal of the connector 130 to the sound compressor 110, respectively, and the sound compressor 110 can independently compress audio signals received through a left input line and right input line of the stereophonic sound collector.

Herein, for description convenience, a description has been made that the stereophonic sound collector collects sound through its left input line and right input line, but the input line of the sound collector may be realized as a multi line of three or more and collect multi-channel stereophonic sound. Therefore, the sound compressor 110 can separate the audio signals received by the stereophonic sound collector into a left signal and a right signal and independently compress the left signal and the right signal, thereby independently compressing collected direct sound into stereophonic sound.

As described above, exemplary embodiments of the present invention can lively collect direct sound signals according to a user's request or can decode compressed sound and output the decoded sound without installing a separate connector in a mobile device, by using a common connector and circuit for an external sound output device such as an earphone, a headphone, a speaker, etc. and an external multi-channel sound collector such as a microphone.

Also, the exemplary embodiments of the present invention can automatically identify a plug type connected to a common connector, and then automatically compress the collected sound and store the compressed sound or automatically decode compressed sound and output the decoded sound to a user.

It will be appreciated that embodiments of the present invention according to the claims and description in the specification can be realized in the form of hardware, software or a combination of hardware and software. Any such software may be stored in a computer readable storage medium. The computer readable storage medium stores one or more programs (software modules), the one or more programs comprising instructions, which when executed by one or more processors in an electronic device, cause the electronic device to perform a method of the present invention. Any such software may be stored in the form of volatile or non-volatile storage such as, for example, a storage device like a ROM, whether erasable or rewritable or not, or in the form of memory such as, for example, RAM, memory chips, device or integrated circuits or on an optically or magnetically readable medium such as, for example, a CD, DVD, magnetic disk or magnetic tape or the like. It will be appreciated that the storage devices and storage media are embodiments of machine-readable storage that are suitable for storing a program or programs comprising instructions that, when executed, implement embodiments of the present invention.

Accordingly, embodiments provide a program comprising code for implementing apparatus or a method as claimed in any one of the claims of this specification and a machine-readable storage storing such a program. Still further, such programs may be conveyed electronically via any medium such as a communication signal carried over a wired or wireless connection and embodiments suitably encompass the same.

Although the invention has been shown and described with reference to certain exemplary embodiments thereof, it will be understood by those skilled in the art that various changes in form and details may be made therein without departing from the spirit and scope of the invention as defined by the appended claims and their equivalents. For example, although the impedance measurement unit 140, the plug identification unit 150, the switching unit 160, and the controller 170, the voltage level measurement unit 190 are illustrated as separate components, these units may be integrated as a single unit. Therefore, the scope of the present invention should not be limited to the above-described embodiments but should be determined by not only the appended claims but also the equivalents thereof.

What is claimed is:

1. A mobile device having a sound compressor and a sound decompressor, comprising:

a connector for receiving a sound collector plug or a sound output plug;

a plug identification unit for identifying whether the plug electrically coupled to the connector is the sound collector plug or the sound output plug;

a switching unit for selectively coupling the plug coupled to the connector to one of the sound compressor and the sound decompressor; and a controller for selectively switching of the switching unit according to an identification outcome, wherein the plug identification unit identifies multi-channel stereophonic sound if three or more audio input lines of the sound collector plug or three or more audio output lines of the sound output plug are identified with compression or decompression of sound.

2. The mobile device of claim 1, further comprising an impedance measurement unit for measuring an impedance level of the plug electrically coupled to the connector, wherein the plug identification unit identifies the plug coupled to the connector on a basis of the impedance level of the plug measured by the impedance measurement unit.

3. The mobile device of claim 1, wherein the connector comprises:

a 1st terminal electrically coupling the sound collector plug;

a 2nd terminal electrically coupling a left output line of the sound output plug; and a 3rd terminal electrically coupling with a right output line of the sound output plug.

4. The mobile device of claim 1, wherein the connector comprises:

a 1st terminal electrically coupling a left output line of the sound output plug or electrically coupling a left input line of the sound collector plug according to the switching of the switching unit; and a 2nd terminal electrically coupling a right output line of the sound output plug or electrically coupling a right input line of the sound collector plug according to the switching of the switching unit.

5. The mobile device of claim 3, further comprising:

a 1st voltage-level measurement unit for measuring a voltage level of the 1st terminal;

a 2nd voltage-level measurement unit for measuring a voltage level of at least one of the 2nd terminal and the 3rd terminal; and a comparator for comparing voltage levels each measured by the 1st voltage-level measurement unit and the 2nd voltage-level measurement unit, wherein the plug identification unit identifies the plug electrically coupled to the connector on a basis of the comparison outcome.

6. The mobile device of claim 1, wherein the sound output plug is an earphone plug, a headphone plug, or a speaker plug, and wherein the sound collector plug is a microphone plug.

7. A driving method of a mobile device having a sound compressor, a sound decompressor, and a connector for receiving a sound collector plug or a sound output plug, the method comprising:

identifying by an identification unit whether the plug electrically coupled to the connector is the sound collector plug or the sound output plug for multi-channel stereophonic sound if three or more audio input lines of the sound collector plug or three or more audio output lines of the sound output plug are associated with compression or decompression of sound; and selectively switching by a switching unit to couple the plug coupled to the connector to one of the sound compressor and the sound decompressor according to an identification outcome.

8. The method of claim 7, further comprising measuring an impedance level of the plug electrically coupled to the connector, wherein the identification is achieved based on a measured impedance level.

9. The method of claim 7, wherein the connector comprises:

a 1st terminal electrically coupling the sound collector plug;

a 2nd terminal electrically coupling a left line of the sound output plug; and a 3rd terminal electrically coupling a right line of the sound output plug, and wherein the identifying step includes:

measuring a voltage level of the 1st terminal and a voltage level of at least one of the 2nd terminal and the 3rd terminal;

comparing the voltage level of the 1st terminal and the voltage level of at least one of the 2nd terminal and the 3rd terminal, and the identifying identifies the plug connected to the connector on a basis of the comparison result.

10. A mobile device having a sound compressor and a sound decompressor, comprising:

a connector for receiving an external sound collector plug or a sound output plug; and a controller for determining whether the plug electrically coupled to the connector is the sound collector plug or the sound output plug by comparing an impedance or a voltage level detected thereon to a predetermined value, and selectively coupling the plug electrically coupled to the connector to one of the sound compressor and the sound decompressor according to a determination outcome, and identifying that the plug is adapted for multi-channel stereophonic sound if three or more audio input lines of the sound collector plug or three or more audio output lines of the sound output plug are associated with compression or decompression of sound.

11. The mobile device of claim 10, wherein the connector comprises:

a 1st terminal electrically coupling the sound collector plug;

a 2nd terminal electrically coupling a left output line of the sound output plug; and a 3rd terminal electrically coupling a right output line of the sound output plug.

12. The mobile device of claim 11, further comprising:

a 1st voltage-level measurement unit for measuring a voltage level of the 1st terminal;

a 2nd voltage-level measurement unit for measuring a voltage level of at least one of the 2nd terminal and the 3rd terminal; and a comparator for comparing voltage levels each measured by the 1st voltage-level measurement unit and the 2nd voltage-level measurement unit, wherein the controller identifies the plug coupled to the connector on a basis of the comparison outcome.

13. The mobile device of claim 10, further comprising an impedance measurement unit for measuring an impedance level of the plug electrically coupled to the connector.

14. The mobile device of claim 13, wherein when impedance level measured by the impedance measurement unit is within a range of 16Ω to 32Ω, the controller determines that the plug is electrically coupled to the sound output plug.

15. The mobile device of claim 13, wherein when impedance level measured by the impedance measurement unit is within a range of 1.5 kΩ to 3.5 kΩ, the controller determines that the plug is electrically coupled to a monophonic microphone plug.

16. The mobile device of claim 15, wherein when the measured impedance is measured as about ½ of the impedance level of the monophonic microphone plug connected to the connector, the controller determines that the plug is electrically coupled a stereophonic microphone plug.

17. The mobile device of claim 10, wherein the sound output plug is an earphone plug, a headphone plug, or a speaker plug.

* * * * *

UNITED STATES PATENT AND TRADEMARK OFFICE

CERTIFICATE OF CORRECTION

PATENT NO. : 9,179,218 B2
APPLICATION NO. : 13/557835
DATED : November 3, 2015
INVENTOR(S) : Sung-Hoon Jeong et al.

It is certified that error appears in the above-identified patent and that said Letters Patent is hereby corrected as shown below:

CLAIMS
Column 12, Claim 9, Line 9 should read as follows:
--...the identifying the plug...--

Signed and Sealed this
First Day of March, 2016

Michelle K. Lee

Michelle K. Lee
*Director of the United States Patent and Trademark Office*